US007829027B2

(12) United States Patent
Osterloh et al.

(10) Patent No.: US 7,829,027 B2
(45) Date of Patent: Nov. 9, 2010

(54) SAMPLE CARRIER

(75) Inventors: Dirk Osterloh, Unna (DE); Ralf-Peter Peters, Bergisch-Gladbach (DE)

(73) Assignee: Boehringer Ingelheim microParts GmbH, Dortmund (DE)

( * ) Notice: Subject to any disclaimer, the term of this patent is extended or adjusted under 35 U.S.C. 154(b) by 1069 days.

(21) Appl. No.: 10/993,156

(22) Filed: Nov. 22, 2004

(65) Prior Publication Data

US 2005/0152807 A1 Jul. 14, 2005

(30) Foreign Application Priority Data

Nov. 21, 2003 (DE) ..... 103 54 806

(51) Int. Cl.
*B01L 3/00* (2006.01)

(52) U.S. Cl. ..... 422/102; 422/73; 422/74; 422/99; 422/100; 422/101; 435/6; 435/58; 73/863

(58) Field of Classification Search ..... 422/73–74, 422/99–102; 435/6, 58; 73/863
See application file for complete search history.

(56) References Cited

U.S. PATENT DOCUMENTS

| | | | | |
|---|---|---|---|---|
| 3,799,742 | A * | 3/1974 | Coleman | 422/61 |
| 4,310,399 | A | 1/1982 | Columbus | |
| 4,473,457 | A | 9/1984 | Columbus | |
| 4,618,476 | A | 10/1986 | Columbus | |
| 4,756,884 | A | 7/1988 | Hillman et al. | |
| 4,775,515 | A | 10/1988 | Cottingham | |
| 4,957,582 | A | 9/1990 | Columbus | |
| 4,963,498 | A | 10/1990 | Hillman et al. | |
| 5,004,926 | A | 4/1991 | Vassenaix et al. | |
| 5,039,617 | A | 8/1991 | McDonald et al. | |
| 5,192,693 | A | 3/1993 | Yazawa et al. | |
| 5,230,866 | A | 7/1993 | Shartle et al. | |
| 5,500,187 | A | 3/1996 | Deoms et al. | |
| 5,744,366 | A | 4/1998 | Kricka et al. | |
| 5,764,356 | A | 6/1998 | Iwase et al. | |
| 5,885,527 | A | 3/1999 | Buechler | |
| 6,113,855 | A | 9/2000 | Buechler | |
| 6,156,270 | A | 12/2000 | Buechler | |

(Continued)

FOREIGN PATENT DOCUMENTS

DE 690 10 200 T2 11/1990

(Continued)

OTHER PUBLICATIONS

Parallel Reactions in Open Chip-Based Nanovials With Continuous Compensation for Solvent Evaporation, Erik Litborn et al., Electrophoresis 2000, 21, pp. 91-99.

*Primary Examiner*—Jyoti Nagpaul
(74) *Attorney, Agent, or Firm*—Roberts Mlotkowski Safran & Cole, P.C.; David S. Safran

(57) ABSTRACT

A sample carrier with a sample receiver for the sample liquid and with preferably several sample chambers which are connected thereto is proposed. In order to avoid refilling with sample liquid when it evaporates or is otherwise lost or used up, there is additionally a reservoir for sample liquid which is covered in the same way as the sample chambers and which has a connecting channel to the environment which can be closed by the sample liquid.

31 Claims, 2 Drawing Sheets

U.S. PATENT DOCUMENTS

| | | | | |
|---|---|---|---|---|
| 6,296,126 | B1 | 10/2001 | Peters | |
| 2002/0019062 | A1 | 2/2002 | Lea et al. | |
| 2002/0182749 | A1 | 12/2002 | Singh et al. | |
| 2003/0118453 | A1 | 6/2003 | Fritsch et al. | |
| 2003/0152927 | A1 * | 8/2003 | Jakobsen et al. | 435/6 |

FOREIGN PATENT DOCUMENTS

| | | | |
|---|---|---|---|
| DE | 198 10 499 | A1 | 9/1999 |
| DE | 100 01 116 | A1 | 7/2001 |
| EP | 0 282 840 | A2 | 9/1988 |
| EP | 0 348 006 | A2 | 12/1989 |
| EP | 0 430 248 | A2 | 6/1991 |
| EP | 0 803 288 | A2 | 10/1997 |
| EP | 0 903 180 | A2 | 3/1999 |
| JP | 6-94724 | A | 4/1994 |
| JP | 11-304672 | A | 11/1999 |
| WO | WO 90/09596 | A1 | 8/1990 |
| WO | WO 99/46045 | A1 | 9/1999 |
| WO | WO 00/25921 | | 5/2000 |

* cited by examiner

SAMPLE CARRIER

BACKGROUND OF THE INVENTION

1. Field of Invention

This invention relates to a sample carrier having sample chambers for receiving samples for analysis.

2. Description of Related Art

In a sample carrier known from practice, the sample chambers are made in a base plate on one side, therefore they are open towards the flat side. After filling with reagents, the sample chambers are covered by a film. For chemical or biological diagnostics, a sample receiver is filled with a sample liquid by means of a pipette or the sample liquid is aspirated, for example, by capillary forces. The sample liquid then flows automatically as a result of capillary forces via a distribution channel and feed channels into the sample chambers. In the sample chambers, the sample liquid reacts with the reagents which have been added beforehand. The reactions are detected, for example, optically.

The reactions which proceed in the sample chambers often last several hours and are often carried out at higher temperatures. The frequently aqueous or other solvent-containing sample liquids are subject to considerable evaporation in spite of the covering, especially as a result of the open or opened sample receiver and the required ventilation.

With high evaporation, it has therefore been necessary in the past to refill the sample receiver with sample liquid. Beyond the associated labor input, there is also the risk here that in the meantime air can flow in or can be sucked in.

Alternatively, the sample receiver can also be re-sealed after first filling with sample liquid by an additional film in order to minimize evaporation. But this means additional expenditure of labor, time, and additional material cost.

SUMMARY OF THE INVENTION

The primary object of this invention is to devise a sample carrier and its use which, even for longer residence time of the sample liquid in the sample carrier, especially for reactions which continue for a long time and/or at high temperatures, can be used without adding sample liquid again, or covering of the sample receiver after the first application of sample liquid.

The aforementioned primary object is achieved by a sample carrier as described in detail below. In this regard, one aspect of this invention is to provide a sample carrier additionally with a covered reservoir for sample liquid so that when the sample liquid evaporates or is otherwise lost or used up, new sample liquid can flow out of the reservoir into the distribution channel and/or the sample chamber(s). The reservoir in the filled state and while being emptied via a connecting channel being connected to the environment, the channel is kept closed by the sample liquid or another liquid in such a way as to allow aspiration or inflow from the atmosphere surrounding the sample carrier, especially air, as the reservoir is being emptied, but to limit or prevent free opposite gas exchange.

The otherwise necessary refilling of the sample receiver with sample liquid can be avoided by the aforementioned execution which can be implemented since the free surface of the sample liquid (therefore exchanging gas with the environment) on which the evaporation rate largely depends, is greatly reduced. Accordingly, the evaporation decreases so that the sample carrier of the present invention can also be used for very long dwell times of the sample liquid in the sample chambers and/or at high temperatures without refilling of the sample receiver with sample liquid being necessary as required in the prior art.

Preferably, a liquid seal which closes automatically by capillary forces, is formed in the connecting channel. This enables easy handling.

The reservoir is preferably made in the form of an additional chamber. Alternatively or in addition, the reservoir can also be formed by an elongated or an additional, preferably winding section, and/or a section which has been enlarged in cross section, that is, the section of the distribution channel to which the sample chambers are connected. This enables a cost-favorable structure.

Preferably the sample liquid is transported on the sample carrier to the desired locations solely by capillary forces. But the transport of sample liquid can also take place alternatively by other mechanisms or not solely by capillary forces.

These and other advantages and features of the present invention will become more apparent from the following detailed description of the preferred embodiments of the present invention when viewed in conjunction with the accompanying drawings.

DETAILED DESCRIPTION OF THE INVENTION

In the various figures, the same reference numbers are used for the same or corresponding parts for clarity, the corresponding or comparable properties and advantages being achieved even if a repeated description is omitted in the text below.

Figure 1:
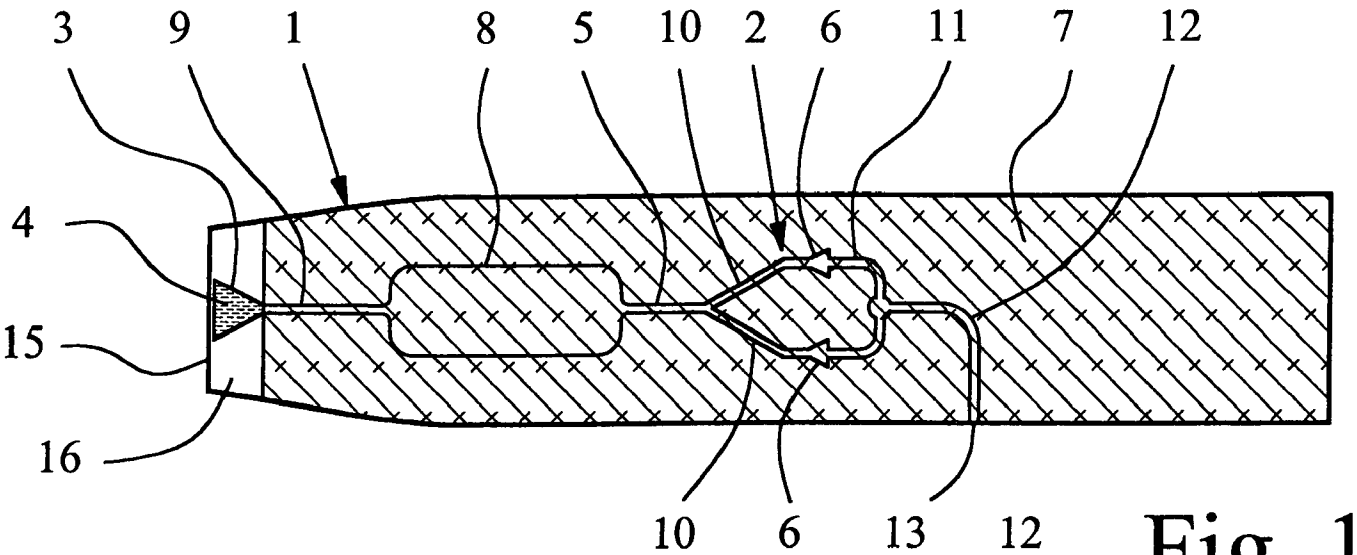
FIG. 1 shows a schematic overhead view of a sample carrier in accordance with the invention according to a first embodiment.

FIG. 1 shows in a schematic overhead view, a first embodiment of a sample carrier 1 in accordance with the present invention. The sample carrier 1 may be called a microtiter plate. The sample carrier 1 includes cavities 2 in the μl range, at least one sample receiver 3 for sample liquid 4, and preferably several sample chambers 6 which are connected to the sample receiver 3 over a common distribution channel 5. The sample carrier 1 can have several sample receivers 3, each of which has at least one distribution channel 5 connected thereto and assigned sample chambers 6 in other embodiments. In the first embodiment, the cavities 2, except for the sample receiver 3, are covered over by an especially film-like covering 7, preferably closed on the top side. Thus, a substantially closed line system or one largely protected against evaporation for the sample liquid 4 is provided.

In the representation as shown in FIG. 1, the sample liquid 4 has already been added or applied to the sample receiver 3, but has not yet flowed into the connected cavities 2. The addition of the sample liquid 4 in the first embodiment is easily possible, since the sample receiver 3 is open to the top, and it is not covered by the covering 7, or possibly only partially covered. If necessary, the sample receiver 3 is closed laterally, especially made in the manner of a cup or a chamber. The sample carrier 1 in accordance with the illustrate embodiment of the present invention in addition has a reservoir 8 which in the first embodiment, is connected on the inlet side to the sample receiver 3 via a connecting channel 9, and on the outlet side to the distribution channel 5. The reservoir 8 is made here in the manner of a cup or chamber and is likewise covered by the covering 7.

After filling, the sample liquid 4 can flow through the connecting channel 9, the reservoir 8, the distribution channel 5, and into the sample chambers 6 via feed channels 10 connected thereto. This takes place preferably automatically by capillary forces. The sample chambers 6 adjoin ventilation channels 11 which for their part, discharge into a ventilation opening 13 which is open to the outside, in order to drain the air or other atmosphere which has been displaced out of the line system by the inflowing sample liquid 4. This may be attained via a connecting segment which has been enlarged in cross section and/or a ventilation collecting channel 12.

Figure 2:
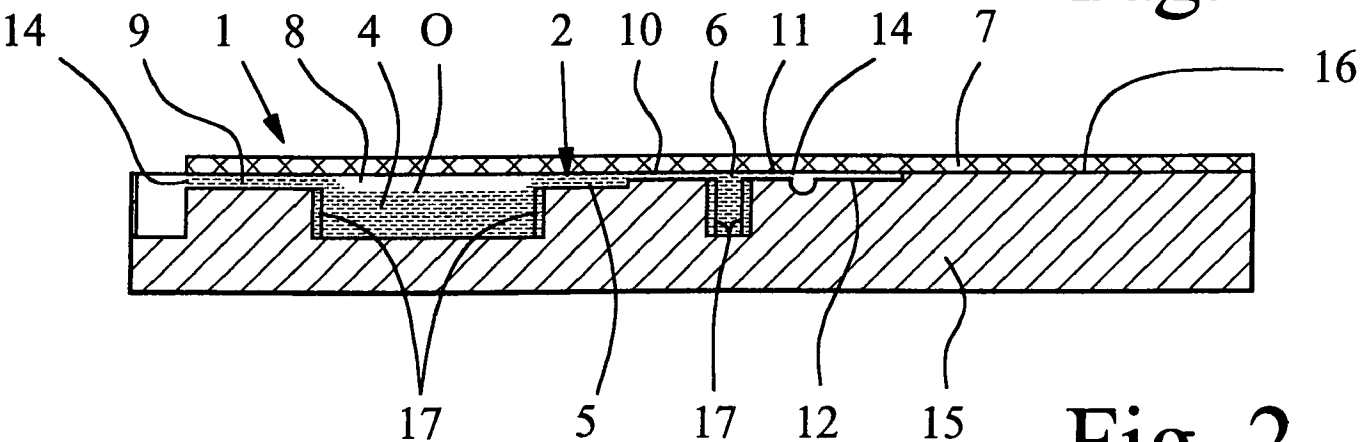
FIG. 2 shows a lengthwise cross section of the sample carrier as shown in FIG. 1.

FIG. 2 shows a schematic lengthwise cross section of the sample carrier 1 as shown in FIG. 1 along the channels 9, 5, 10, 11, and 12, but in the state in which the sample liquid 4 has flowed out of the sample receiver 3 into the connected cavities 2. The sample liquid 4 in the embodiment shown preferably does not flow out of the sample chambers 6 into the ventilation channels 11, since in particular, based on the corresponding execution or cross section differences, a liquid stop 14 is formed. Capillary forces and/or gravity prevent the sample liquid 4 from flowing into the ventilation channels 11. The liquid stops 14 can also be formed only at the transition of the ventilation channels 11 into the ventilation collecting channel 12, especially by the connecting segment which has been enlarged in cross section, as is indicated in FIG. 2. Alternatively or in addition to the liquid stops 14, there can also be valves or other suitable means, which are not shown, for manipulation of the sample liquid 4. Alternatively or in addition to the filling of the other cavities 2 which are connected to the sample receiver with sample liquid 4 from the sample receiver 3 and filled by capillary force, the sample liquid 4 can also be pumped, drawn or conveyed by other effects.

Preferably all the cavities 2 are formed in the base body 15 of the sample carrier 1. In particular, all cavities 2 are open proceeding from the flat side 16 of the base body 15 and toward the flat side 16, formed for example, by cups, riffles, grooves, recesses or the like. The covering 7 is cemented, laminated or in some other way, applied to the base body 15 and its flat side 16, and covers all cavities 2 of the sample carrier 1, except for the sample receiver 3 in the first embodiment, so that the cavities 2 are also closed to the top, as indicated in FIGS. 1 and 2. In the embodiment, the sample carrier 1 is thus made preferably in two parts. Alternatively, the sample carrier 1 can also be made in one part or can have several coverings 7 which can optionally be applied separately. Instead of the preferred film-like execution of the covering 7, it can also be formed, for example, by a glass plate or other suitable material with suitable properties with suitable shaping.

With respect to the base body 15 and the covering 7, it should be noted that a coated material, especially plastic, may be preferably used, which is suitable for the desired wetting properties, at least in the area of the connecting channel 9 and/or of the liquid stop 14, and/or is modified or can also be modified in areas, for example, at least partially hydrophilic for aqueous solvents or sample liquids 4 or hydrophobic for lipophilic solvents or sample liquids 4. Preferably, good wettability is achieved by plasma polymerization.

In the sample chambers 6, after the inflow of sample liquid 4, measurements, manipulations, studies or reactions, for example for biological, especially microbiological, or chemical diagnostics, can take place, especially with or by reagents (not shown) located in the sample chambers 6, or by some other action. Preferably, the reagents are placed in the sample chambers 6 before applying the covering 7. In order to be able to track or carry out the studies or reactions preferably optically, for example by transmission, fluorescence or turbidity measurements, the covering 7 and/or the base body 15 is or are produced, preferably from relatively transparent material, or is or are made transparent preferably at least in areas, especially above/and underneath the sample chambers 6.

In studies, manipulations and/or reactions lasting several hours and/or at high reaction or ambient temperatures of, for example 37° C., at which especially microbiological reactions often proceed, and/or at comparatively low atmospheric humidity, the evaporation of the sample liquid 4 is considerable in spite of the covering 7. In particular all sample chambers 6 are connected to the environment via the required ventilation, in the illustrated embodiment, the ventilation channels 11 and the ventilation collecting channel 12. Furthermore, the sample liquid 4 can evaporate unhindered from the sample receiver 3, especially if, as was conventional in the past, there is no reservoir 8 and the sample liquid as the evaporation reservoir is still present in the sample receiver 3 after filling of the sample chambers 6. Evaporation leads to the fact that refilling the sample receiver 3 with sample liquid 4 is conventionally necessary. Here, the risk is that when not refilled at the proper time, air penetrates into the line system, especially the distribution channel 5 and the adjoining sample chambers 6. This can lead to unwanted or unusable results or reactions, especially in the sample chambers 6.

In accordance with the present invention, the sample carrier 1 additionally has a reservoir 8 for the sample liquid 4. When the sample liquid 4 evaporates or is otherwise lost or used up, new sample liquid 4 can flow out of the reservoir 8 into the distribution channel 5 and into the sample channels 6, and/or can flow back into the connecting channel 9. In the first embodiment, the reservoir 8 as a result of its arrangement in series between the sample receiver 3 and the sample chambers 6, can be filled with sample liquid upstream of the sample chambers 6.

The sample carrier 1 of the illustrated embodiment is preferably formed with the corresponding choice of the cross sections of the channels 5, 10, 11, 9 and/or with the corresponding execution of the transitions between them and the chambers 3, 6, 8, such that proceeding from the state filled with the sample liquid 4 (therefore, filled sample chambers 6) when the sample liquid 4 evaporates or is otherwise lost or used up, emptying first of the sample receiver 3 takes place. If this has not yet taken place at this time, then emptying of the reservoir 8 and subsequently of the distribution channel 5 and the feed channels 10, so that the sample chambers 6 remain filled with sample liquid 4. This can be achieved especially in that by the correspondingly high capillary forces and/or valves which are not shown the sample liquid 4 is prevented from subsiding from the sample chambers 6 and from the liquid stops 14 during the aforementioned emptying process.

As a result of the covering of the reservoir 8 by the covering 7 after the sample liquid 4 flows out of the sample receiver 3 into the connected cavities 2 including the reservoir 8, the evaporation of the sample liquid 4 is greatly reduced since the reservoir 8 is connected simply via the comparatively small cross section of the connecting channel 9 to the environment.

The sample carrier 1 is made such that sample liquid 4 is always in the connecting channel 9, even when the reservoir 8 is being emptied or is being pulled into it by capillary forces, so that the connecting channel 9 is kept at least temporarily, or at least essentially, continuously sealed by the sample liquid 4, as indicated in FIG. 2. The sealing of the connecting channel 9 by sample liquid 4 can also take place such that the sample liquid 4 seals only the feed opening of the connecting channel 9, which opening discharges into the reservoir 8, therefore sealing the connecting channel 9 only on the reservoir side. Preferably the connecting channel 9 remains filled with sample liquid 4 as far as the inlet-side end towards the opening to the sample receiver 3, especially up to a liquid stop 14 which has formed there. Alternatively, the connecting channel 9 remains refilled automatically from the reservoir 8. The liquid seal which is formed in this way causes the ambient atmosphere to be able to only be taken in or to flow into the reservoir through the connecting channel 9 and prevents other gas exchange between the surface O of the sample liquid 4 in the reservoir 8 and the environment.

So that the sample liquid, even with a falling level in the reservoir 8 and corresponding emptying of the reservoir, can rise to the connecting channel 9 and can close it, there is preferably a capillary force producing means 17 which will be detailed later, which allows the sample liquid 4 to rise out of the reservoir 8 to the connecting channel 9. The sample carrier 1 is then made such that sample liquid 4 is always pulled out of the reservoir 8 to the connecting channel 9, or into it as long as there is sample liquid 4 in the reservoir 8. Alternatively, an amount of sample liquid can also be fundamentally separated from the sample liquid 4 which is located in the reservoir 8, and can produce the desired sealing of the connecting channel 9. Then, preferably another reservoir (not shown) for the sample liquid 4 may be assigned to the connecting channel 9 for equalization of evaporation losses and for maintaining the liquid seal.

The sealing of the connecting channel 9 by the sample liquid 4 leads to the fact that only the liquid surface in the connecting channel 9, but not the entire surface O of the sample liquid 4 in the reservoir 8 or its base area which is larger especially by a factor of 10, 100 or even 1000 than the cross sectional area of the connecting channel 9, is in gas exchange with the environment, and therefore, is subject to evaporation. Accordingly, the liquid seal leads to greatly reduced evaporation, since the surface O of the sample liquid 4 in the reservoir 8 is not in gas exchange with the environment.

When the reservoir 8 is being emptied, the liquid seal is maintained at least essentially continuously, and with a corresponding negative pressure in the reservoir 8 allows simply (briefly) ambient atmosphere or air to flow into the reservoir 8 for aeration or pressure equalization. Immediate closure then occurs again by capillary force. The liquid seal then acts accordingly as a one-way valve and prevents or at least hinders gas exchange between the reservoir 8 and the environment.

The liquid seal constitutes an especially preferred, effective approach which can be economically implemented. If necessary, instead of a sample liquid 4, some other liquid, for example a control liquid, can also be used. This is especially advantageous when only little or not enough sample liquid 4 is available. Alternatively or in addition, instead of a liquid seal, also some other valve, especially a suitable one-way valve, can be used.

According to one version of the invention which especially minimizes evaporation, the reservoir 8 has a smaller opening area for feed of sample liquid 4 and/or for ventilation or aeration, especially in the area of the liquid stop 14, than the distribution channel 5. By the corresponding dimensioning of the reservoir 8, it is therefore possible to use the sample carrier 1 without refilling the sample receiver 3 with sample liquid 4 even for long reaction times and/or at high temperatures.

Preferably, the holding volume of the reservoir 8 for the sample liquid 4 is at least 5%, preferably at least 10%, especially at least 20%, of the holding volume of the connected cavities 2 which hold the sample liquid 4, of the sample receiver 3 and/or of all connected sample chambers 6. Preferably, the holding volume of the sample receiver 3 is essentially the same or less than the sum of the holding volumes of the connected cavities 2, especially of the distribution channel 5, of the connecting channel 9, of the reservoir 8, of the sample chambers 6, and/or of the feed channels 10, and/or optionally of the ventilation channels 11, especially so that after filling the sample receiver 3 with sample liquid 4, this added amount is accommodated directly by the connected cavities 2, preferably automatically by capillary forces, as already mentioned.

Accordingly, the sample liquid 4 flows out of the reservoir 8, preferably automatically, especially by capillary forces, into downstream or connected cavities 2 which hold the sample liquid 4, such as the distribution channel 5, the feed channels 10 and the sample chambers 6 and optionally the ventilation channels 11. As already explained, the reservoir 8 can be emptied, preferably only temporarily after the sample receiver 3 is emptied. Furthermore, the distribution channel 5 and/or the feed channels 10 can preferably by emptied only after the reservoir 8 is emptied. In the embodiment, each sample receiver 3 and/or each distribution channel 5 is assigned only a single reservoir 8. Preferably therefore, the sample liquid 4 from the same reservoir 8 can be supplied to all sample chambers 6 which are connected to the same distribution channel 5. But alternatively or in addition, there can also be other reservoirs 8 so that the sample chambers 6 can be assigned in groups or individually to the reservoirs 8. Preferably the sample chambers 6 are located fluidically between the reservoir 8 and the assigned liquid stop 14 or, for example, valves which are not shown.

In order to produce the required capillary forces which cause the desired flow of sample liquid 4, the sample receiver 3 and the reservoir 8 and optionally, the sample chambers 6, each have preferable capillary force producing means 17 in the area of their vertical walls. These capillary force producing means 17 preferably each have a vertical riffle or wedge-shaped groove with such a wedge angle that the sample liquid 4 can rise or fall by capillary forces and can flow into the connecting channel 9, the distribution channel 5 and/or optionally into the ventilation channels 11. Capillary force producing means 17 implemented as a wedge-shaped recess is shown and described in EP 1 013 341 A2. In particular, one capillary force producing means 17 at a time is provided in the sample receiver 3 towards the connecting channel 9, from the latter into the reservoir 8, in the reservoir 8 to the distribution channel 5, from the feed channels 10 into the sample chambers 6, and optionally from the latter into the ventilation channels 11. Other embodiments of the present invention are detailed below using the other figures. However, only the primary differences as compared to the first embodiment are described in detail. Otherwise, the aforementioned explanations apply accordingly to these other embodiments as well.

Figure 3:
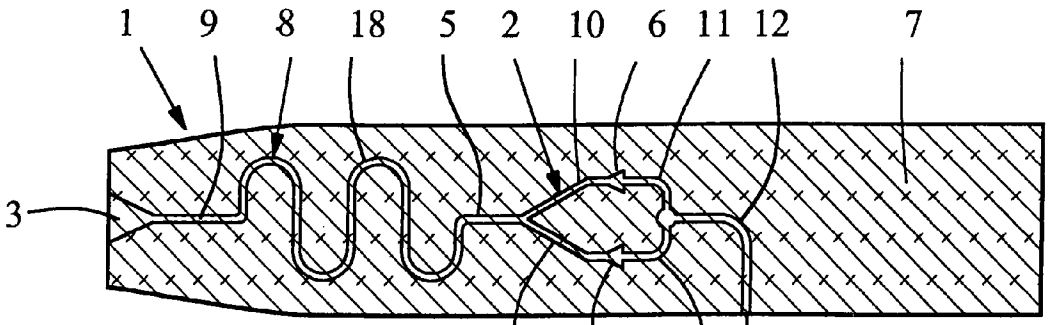
FIG. 3 shows a schematic overhead view of a sample carrier in accordance with the invention according to a second embodiment.

FIG. 3 is a schematic overhead view similar to FIG. 1 of a second embodiment of the sample carrier 1. In contrast to the first embodiment, the covering 7 here covers over all cavities 2, therefore, the sample receiver 3 and optionally also other sample receivers 3 and other cavities 2 of the sample carrier 1, if present. In order to facilitate filling of the sample receiver 3 with sample liquid 4, especially by means of a pipette or the like (not shown), the covering 7 in the area of the sample receiver 3 is pre-notched, perforated, incised, weakened or provided with other scoring. The covering 7 is accordingly partially open or can be partially opened in the area of the sample receiver 3 so that here still comparatively high evaporation of the sample liquid 4 from the sample receiver 3 can occur. The sample liquid 4 which has been taken up by the reservoir 8 is conversely subject to much less evaporation, so that by means of the reservoir 8, as in the first embodiment, refilling of the sample receiver 3 with sample liquid 4 can be avoided, even for very long residence times of the sample liquid 4 in the sample chambers 6 and/or at high temperatures.

In the second embodiment, the reservoir 8 is not made chamber-shaped, but is formed by a preferably additional segment 18 of the distribution channel 5, a segment which winds especially in a meander-shape. Alternatively or additionally, the segment 18 can have at least in areas, a cross section which has been enlarged compared to the distribution channel 5 in order to achieve a sufficient reservoir volume, optionally there being the corresponding capillary force producing means 17 on the inlet and/or outlet side. In the second embodiment, there is also a liquid seal of the connecting channel 9 in the manner already explained.

Figure 4:
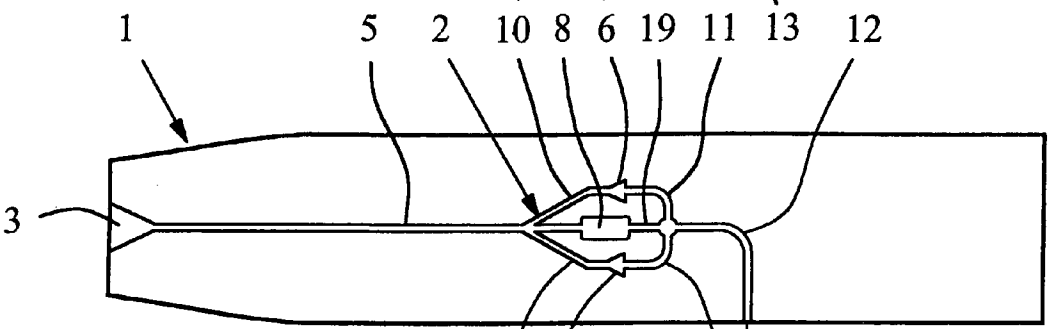
FIG. 4 shows a schematic overhead view of a sample carrier in accordance with the invention according to a third embodiment.
Figure 5:
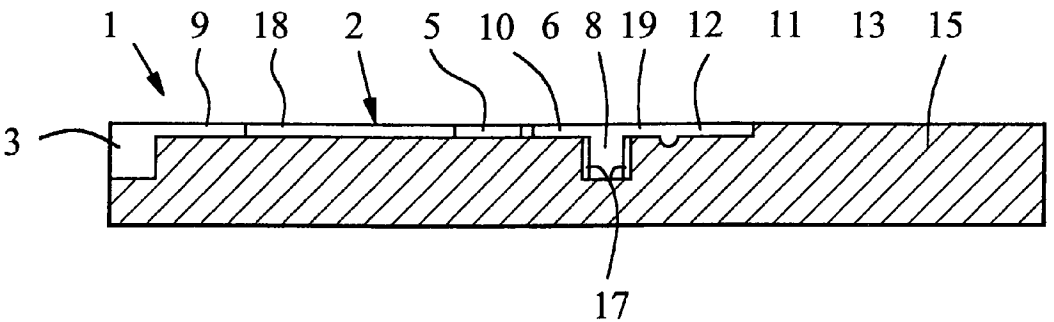
FIG. 5 shows a lengthwise cross section of the sample carrier as shown in FIG. 4.

In FIGS. 4 and 5, the sample liquid 4 and the covering 7 are omitted for the sake of simplification, FIG. 4 showing an overhead view which corresponds to FIGS. 1 and 3. FIG. 4 shows a third embodiment of the sample carrier 1. The reservoir 8 is connected to the distribution channel 5 parallel to the sample chambers 6. In particular, the reservoir 8, after or with the sample chambers 6 and their feed channels 10, is connected to the latter on the end of the distribution channel 5 so that the reservoir 8 can be filled with sample liquid 4 after the sample chambers 6, in order to first allow rapid filling of the sample chambers 6 with sample liquid 4.

In the third embodiment, the reservoir 8 is made preferably in the manner of a cup or chamber. In addition, the reservoir 8 is connected to the ventilation collecting channel 12 for ventilation and aeration via another connecting channel 19. Preferably between this other connecting channel 19 and the reservoir 8 or the ventilation collecting channel 12, a liquid stop 14 and/or a liquid seal is formed in the manner which has already been explained in conjunction with the first embodiment. Thus, the sample liquid 4 does not flow out of the reservoir 8 into the ventilation collecting channel 12 and evaporation of the sample liquid 4 out of the reservoir 8 is prevented even while it is being emptied.

The capillary forces in the area of this liquid stop 14 or in the connecting channel 19 and/or in the reservoir 8 are in turn, matched to the other cavities 2 which are filled (or can be filled) with the sample liquid 4 such that upon evaporation or other loss or consumption of the sample liquid 4, new sample liquid 4 flows or flows back out of the reservoir 8 into these cavities 2 through the distribution channel 5, the feed channels 10, the sample chambers 6 and/or optionally the ventilation channels 11 which are connected to the sample chambers 11. This is attained without the liquid seal of the other connecting channel 19 by the sample liquid 4 allowing gas exchange between the emptying reservoir 8 and the environment, except for intake of ambient atmosphere or air for pressure equalization. The lengthwise cross section of FIG. 5 of the sample carrier 1 shown in FIG. 4 illustrates the structure and the execution of the cavities 2 in the base body 15.

In the third embodiment, to the extent desired or necessary, capillary force producing means 17 may be provided on the corresponding transitions, especially in the reservoir 8 towards the other connecting channel 19. In the third embodiment, the sample receiver 3 is preferably made open to the side, and with the corresponding covering by the cover (not shown), forms an intake area which can intake the sample liquid 4, for example blood, directly from the finger of the individual being examined, preferably automatically by capillary forces, into the sample carrier 1.

Of course, various features of all embodiments described above can be combined with one another as necessary, and any or the same embodiments of reservoir-distribution channel combinations can be used together.

Tests with a sample carrier 1 at a temperature of 37° C.±1° C. and a relative atmospheric humidity of roughly 30% have shown, by way of example, that with initial metering of an added amount x of sample liquid 4 into the sample receiver 3, refilling after 1.0 hr was necessary without the reservoir 8, after more than 3.0 hr for a reservoir 8 with a holding volume of roughly x/10, and after more than 6 hr for a reservoir 8 with a holding volume of roughly x/5. These tests confirm the surprisingly high effectiveness of the reservoir 8 of the present invention described.

The sample carrier 1 in accordance with the present invention may advantageously be used for microbiological diagnostics, the sample chambers 6 being filled with sample liquid 4 and the reactions which are taking place in the sample chambers 6 and/or studies and measurements for diagnostics being automatically analyzed or carried out, especially by automatic analyzers and/or especially over several hours, preferably at roughly 37° C., without refilling with the sample liquid 4.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. Sample carrier comprising:

at least one sample receiver for a sample liquid;

a plurality of sample chambers in which at least one of measurements, manipulations, studies and reactions is performable and each of which is fluidically connected in parallel to the sample receiver via a distribution channel by a separate feed channel that extends from the respective sample chamber to the distribution channel;

a reservoir only for storing a quantity of the sample liquid and feeding connected sample chambers with the sample fluid, the reservoir comprising a reservoir inlet and a reservoir outlet, the reservoir inlet being fluidically connected to the distribution channel by a feed channel that is separate from and in a parallel relationship with the feed channel to each of the sample chambers and the reservoir outlet being fluidically connected to a connecting channel that is open to the environment, wherein the reservoir has a holding volume for sample liquid that is at least 5% greater than a holding volume of the plurality of sample chambers; and a covering which covers over the sample chamber, the distribution channel and the reservoir;

wherein the reservoir is connected to the distribution channel in a manner causing the reservoir to be filled with sample liquid after the sample chambers, in order to first allow filling of the sample chambers with sample liquid prior to filling of the reservoir with sample liquid;

wherein, when sample liquid in the sample chambers evaporates, is lost or used up, new sample liquid is able to flow out of the reservoir and into at least one of the sample chambers via the respective feed channel and connection to the distribution channel, wherein means are provided for causing the connecting channel to be kept sealed by a liquid seal when the reservoir is being filled and when the reservoir is being emptied, and wherein the atmosphere is only allowed to pass through the connecting channel into the reservoir.

2. Sample carrier as claimed in claim 1, wherein the reservoir is fluidically connected to the environment via a plurality of connecting channels, each connecting channel having a said liquid seal.

3. Sample carrier as claimed in claim 1, wherein the means for causing the connecting channel to be kept sealed by a sealing liquid comprises a means for creating capillary forces acting between the reservoir and the connecting channel.

4. Sample carrier as claimed in claim 3, wherein the means for creating capillary forces comprises a vertical rifle or wedge-shaped groove in a wall of the reservoir.

5. Sample carrier as claimed in claim 1, wherein capillary means are provided for conveying sample liquid automatically out of the sample receiver and into at least one of the at least one sample chamber and the reservoir as a result of only capillary forces.

6. Sample carrier as claimed in claim 1, wherein capillary means are provided for conveying sample liquid automatically out of the reservoir into the at least one sample chamber as a result of only capillary forces.

7. Sample carrier as claimed in claim 1, wherein the sample carrier is dimensioned with sufficient volume to hold enough sample liquid to avoid the need for refilling for at least three hours after initially filling the sample receiver.

8. Sample carrier as claimed in claim 1, wherein the reservoir is positioned relative to at least one of the distribution channel and the at least on sample chamber to preclude emptying of the at least one of the distribution channel and the at least on sample chamber before the reservoir.

9. Sample carrier as claimed in claim 1, wherein the sample carrier has a plate-shaped base body in which the sample receiver, the plurality of sample chambers, distribution channel, the reservoir and the connecting channel are provided.

10. Sample carrier as claimed in claim 9, wherein the covering covers over the base body except for at least a portion of the sample receiver and end of the connecting channel that is open to the environment.

11. Sample carrier as claimed in claim 1, wherein the covering is made of a film.

12. Sample carrier as claimed in claim 1, wherein the sample receiver is fill area for receiving the sample liquid into the sample carrier.

13. Sample carrier as claimed in claim 1, wherein a single reservoir is fluidically connected to the at least one sample receiver.

14. Sample carrier as claimed in claim 1, wherein the covering of the sample receiver is openable for adding sample liquid to the sample carrier.

15. Sample carrier as claimed in claim 1, wherein the holding volume of the sample receiver is not greater than the sum of the holding volumes of the sample receiver, the reservoir, and the distribution channel.

16. Sample carrier as claimed in claim 15, wherein the holding volume of the sample receiver is substantially the same as the sum of the holding volumes of the sample receiver, the reservoir, and the distribution channel.

17. Sample carrier as claimed in claim 1, wherein the reservoir is also fluidically connected to the at least one sample receiver.

18. Sample carrier as claimed in claim 1, wherein the at least one sample receiver is a plurality of sample receivers, and the reservoir is also fluidically connected to the plurality of sample chambers.

19. Sample carrier as claimed in claim 1, wherein the reservoir is fluidically connected to the at least one sample receiver via the connecting channel, the connecting channel being implemented as a capillary.

20. Sample carrier as claimed in claim 1, wherein the reservoir includes a capillary force producing means on at least one of an inlet side and an outlet side of the reservoir.

21. Sample carrier as claimed in claim 1, wherein the reservoir is defined by a segment of the distribution channel, the segment having at least one of winding path and an enlarged in cross sectional dimension.

22. Sample carrier as claimed in claim 1, wherein the reservoir is implemented as a chamber.

23. Sample carrier as claimed in claim 1, wherein at least one of the reservoir and the plurality of sample chambers are connected for aeration or ventilation via liquid stops or valves.

24. Sample carrier as claimed in claim 1, wherein at least one of the reservoir and the connecting channel has a region with a reduced opening area for the sample liquid which allows formation of the liquid seal.

25. Sample carrier as claimed in claim 1, wherein a free surface of the sample liquid in the reservoir is larger at least by a factor of 10 than a surface of at least one of the sample liquid which is exposed to the environment, and a cross-sectional area of the connecting channel.

26. Sample carrier as claimed in claim 1, wherein the plurality of sample chambers are located fluidically between the reservoir and the sealing liquid.

27. Sample carrier as claimed in claim 26, wherein means is provided for maintaining the liquid seal even when the amount of sample liquid in the reservoir and the distribution channel diminishes.

28. Sample carrier as claimed in claim 1, wherein the sample carrier is implemented as at least one of a microtiter plate and a test strip.

29. Sample carrier as claimed in claim 1, wherein the holding volumes of each of the sample receiver, the at least one sample chamber, and the distribution channel is less than 1 ml.

30. Sample carrier as claimed in claim 1, wherein the liquid seal is formed by the sample liquid.

31. Sample carrier as claimed in claim 1, wherein the liquid seal is formed by a liquid other than the sample liquid.

* * * * *